United States Patent [19]

Sakai, Haruo et al.

[11] Patent Number: 4,939,333

[45] Date of Patent: Jul. 3, 1990

[54] ELECTRIC APPARATUS WITH A CONTROLLED TURNTABLE

[75] Inventors: Sakai Haruo; Sakai Masayuki, both of Otsu; Koide Satishi, Ibaraki, all of Japan

[73] Assignee: Sanyo Electric Co., Ltd., Japan

[21] Appl. No.: 407,651

[22] Filed: Sep. 15, 1989

[30] Foreign Application Priority Data

Sep. 19, 1988 [JP] Japan ..... 63-234132
Dec. 27, 1988 [JP] Japan ..... 63-332842
Apr. 18, 1989 [JP] Japan ..... 1-98325

[51] Int. Cl.[5] ..... H05B 6/78

[52] U.S. Cl. ..... 219/10.55 F; 219/10.55 B; 219/10.55 E; 219/518; 108/20; 108/142; 99/443 R; 126/338

[58] Field of Search ..... 219/10.55 B, 10.55 F, 219/10.55 E, 10.55 R, 518, 389; 108/20, 21, 139, 142; 126/338; 99/443 R; 340/686

[56] References Cited

U.S. PATENT DOCUMENTS 4,308,445 12/1981 Offutt ..... 219/10.55 F
4,714,811 12/1987 Gerling et al. ..... 219/10.55 F

FOREIGN PATENT DOCUMENTS 47-8293 3/1972 Japan .
57-121190 7/1982 Japan .

*Primary Examiner*—Philip H. Leung
*Attorney, Agent, or Firm*—Beveridge, DeGrandi & Weilacher

[57] ABSTRACT

Disclosed is an electric apparatus comprising a housing with a door, a turntable arranged in the housing for rotating an object, a synchronous motor for driving the turntable, and a control portion for controllling the driving of the synchronous motor, the control portion having apparatus for storing the time required for the turntable to rotate once, apparatus for determining whether or not a time period which is approximately a natural number multiple of the time required for the turntable to rotate once, has elapsed since initiation of turntable rotation, and apparatus for stopping an operation for the rotation of the turntable on the basis of the determination that time, which is approximately a natural number multiple of the time required for one rotation of the turntable, has elapsed. When the synchronous motor is energized during only the time which is approximately a natural number multiple of the time required for the turntable to rotate once, the turntable stops after it rotates approximately a natural number of times. Accordingly, the object placed on the turntable is stopped in the same position within the housing as that at the time when the rotation of the turntable was initiated, so that the object can be easily taken out.

11 Claims, 14 Drawing Sheets

(a)

(b)

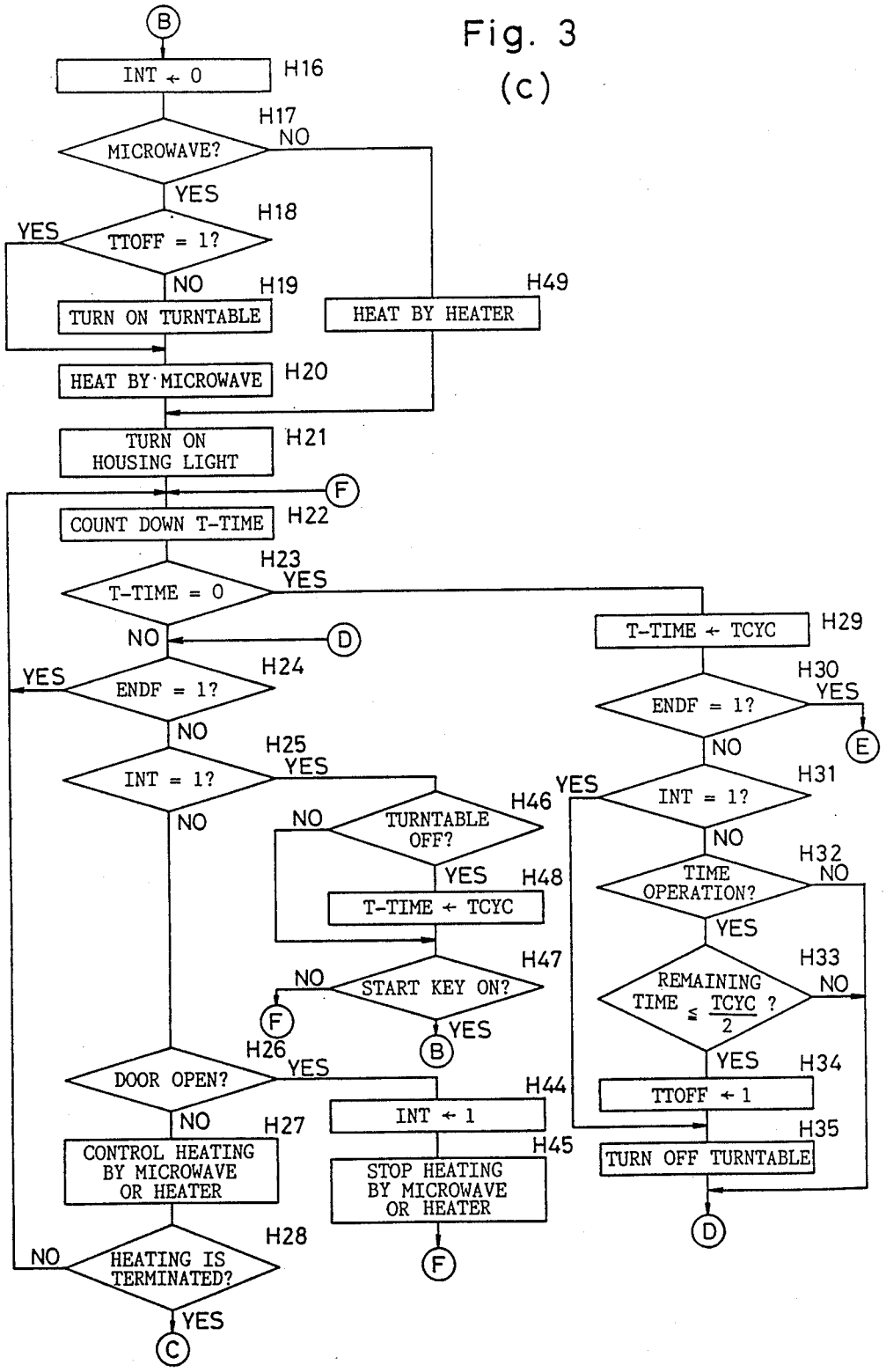
Fig. 3
(c)
B
INT ← 0
H16
H17
MICROWAVE?
NO
YES
H18
YES
TTOFF = 1?
NO
H19
TURN ON TURNTABLE
H49
HEAT BY HEATER
HEAT BY MICROWAVE
H20
TURN ON HOUSING LIGHT
H21
F
COUNT DOWN T-TIME
H22
H23
T-TIME = 0
YES
NO
D
T-TIME ← TCYC
H29
YES
ENDF = 1?
H24
NO
H30
ENDF = 1?
YES
E
NO
H25
INT = 1?
YES
NO
YES
INT = 1?
H31
H46
NO
TURNTABLE OFF?
YES
H48
T-TIME ← TCYC
NO
H32
TIME OPERATION?
NO
YES
H47
NO
START KEY ON?
F
YES
B
H33
REMAINING TIME ≤ TCYC/2 ?
NO
H26
DOOR OPEN?
YES
YES
H34
TTOFF ← 1
H44
INT ← 1
NO
H27
CONTROL HEATING BY MICROWAVE OR HEATER
H45
STOP HEATING BY MICROWAVE OR HEATER
H35
TURN OFF TURNTABLE
D
H28
NO
HEATING IS TERMINATED?
F
YES
C (d)

ELECTRIC APPARATUS WITH A CONTROLLED TURNTABLE

BACKGROUND OF THE INVENTION

The present invention relates generally to an electric apparatus having a turntable on which an object is placed and rotated, for example, to be heated and/or dried, and more particularly, to an electric apparatus such as a microwave oven or an oven having a turntable on which a food is placed and rotated to be cooked and/or dried.

A microwave oven for controlling the stop of a turntable such that the position, within a housing, of a food placed on the turntable is the same as the position where the food is on the turntable when heating is terminated, has been heretofore disclosed (see Japanese Utility Model Publication No. 8293/1972). According to this disclosure, if the food is placed in a forward position on the turntable, the turntable is stopped after heating is terminated such that the position where the food was placed is in a forward portion within the housing, so that the food can be easily taken out from the turntable.

Accordingly, the above described microwave oven is provided with a cam for detecting the rotating position of the turntable and a switch urged by this cam. The turntable stops in response to an output of the switch. Thus, the cam for detecting a rotating position of the turntable, the switch and the like are required, causing the cost of the microwave oven to be increased. In addition, a space for locating the cam, the switch and the like is required, causing the size of the microwave oven to be increased.

SUMMARY OF THE INVENTION

An object of the present invention is to simply and precisely achieve control of the position where a turntable in an apparatus rotates without increasing the cost and the size of the apparatus.

The apparatus according to the present invention comprises a housing with a door, a turntable arranged in the housing for rotating an object placed thereon, a synchronous motor for driving the turntable, and a control portion to control the drive of the synchronous motor.

The above described control portion comprises means for storing time required for one rotation of the turntable, means for determining whether or not time which is approximately a natural number multiple of the time required for the turntable to rotate once has elapsed, and means for stopping an operation for rotating the turntable on the basis of the determination as to whether or not time which is approximately a natural number multiple of the time required for the turntable to rotate once has elapsed.

The synchronous motor for driving the turntable has the property that the rotational speed is precisely constant under a constant frequency of the power supply applied, so that the time required for the turntable driven by the synchronous motor to rotate once is accurately determined. Consequently, if the synchronous motor is energized during a time period which is approximately a natural number multiple of the constant time required for the turntable to rotate once, the turntable stops after rotating a natural number of times.

Accordingly, the object placed on the turntable is stopped in the same position within the housing as that at the time when the rotation is started, so that the object is easily taken out.

Additionally, if time required to energize the synchronous motor is controlled by a microcomputer, the apparatus is not more complicated in construction, as compared with the prior art apparatus. A cam for detecting the position where the turntable rotates, a switch and the like are not required, so that the number of parts and a space for installing the parts can be prevented from being increased. Consequently, the increase in the cost and the size of the apparatus can be significantly suppressed.

The foregoing and other advantages of the present invention will become more apparent from the following description when taken in conjunction with the accompanying drawings.

BRIEF DESCRIPTION OF THE DRAWINGS

FIG. 1(*b*) is a cross sectional plan view showing the housing of the microwave oven;

DESCRIPTION OF THE PREFERRED EMBODIMENT

Embodiment 1

Figure 1:
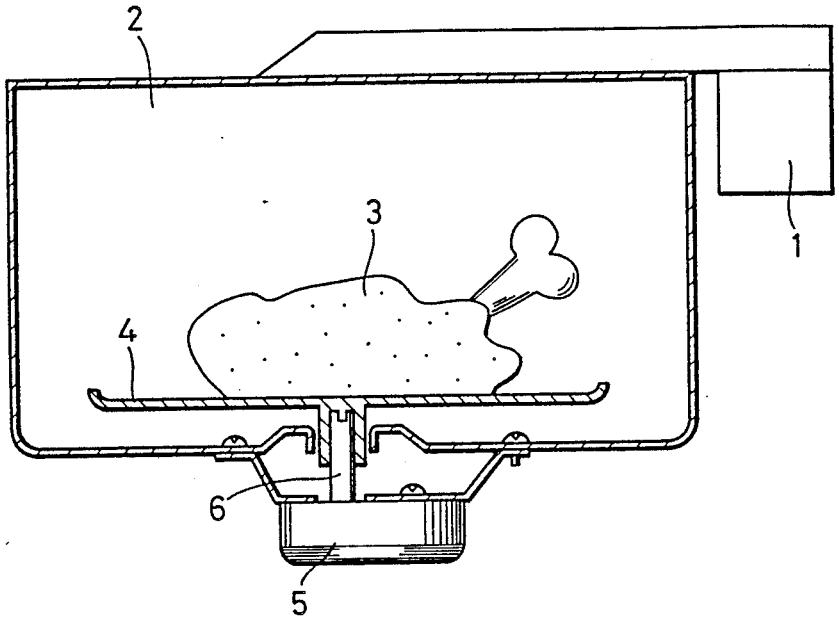
FIG. 1(*a*) is a sectional side elevation view showing a housing of a microwave oven.
Figure 1:
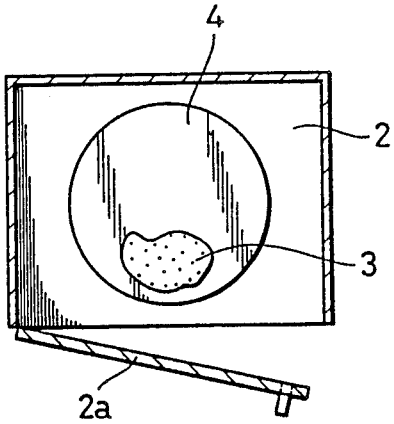

FIGS. 1(*a*) and 1(*b*) illustrate a microwave oven. A reference numeral 2 denotes a housing with a door 2*a* for containing foods, to which microwaves are supplied from a magnetron 1. A turntable 4 on which a food is placed is arranged in the bottom portion of the housing 2. The turntable 4 is connected to an output shaft 6 of a synchronous motor 5, containing a reduction gear, fixed under the housing 2. The rotation of the turntable 4 is driven by driving of the synchronous motor 5.

The synchronous motor 5 has the property that the rotational speed thereof is constant if the frequency of the commercial power supply to be applied thereto is constant. Accordingly, time required for the turntable to rotate once is precisely determined depending on the frequency of the commercial power supply.

Figure 2:
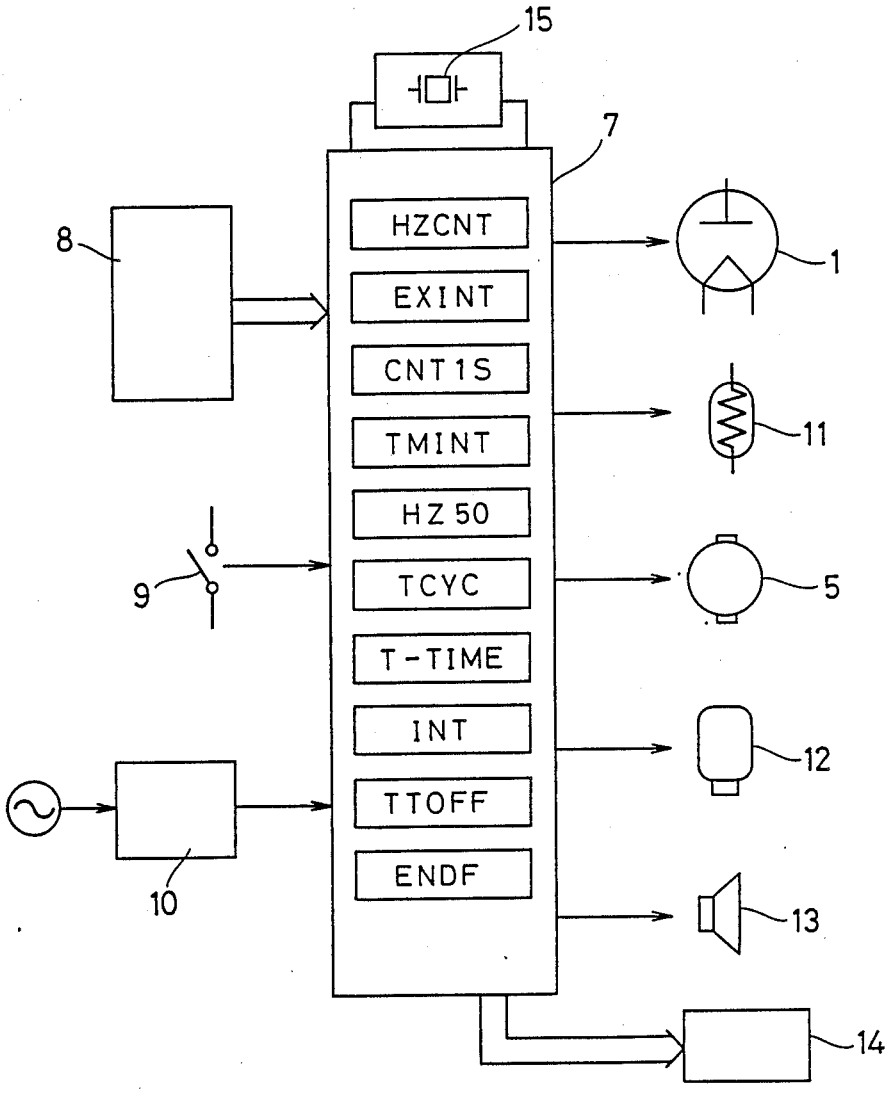
FIG. 2 is a diagram showing a circuit for controlling heating according to a first embodiment.

FIG. 2 illustrates a circuit for controlling heating of a microwave oven. Various desired signals are inputted to a microcomputer 7 from a keyboard 8 for setting heating conditions or the like, a door switch 9 for turning on/off in response to the movement of a front door 2a (not shown) for opening or closing a housing 2, a pulse generator 10 receiving the commercial power supply as an input for generating pulses having the same frequency as that of the commercial power supply, and the like. In addition, the microcomputer 7 controls a magnetron 1 for oscillating microwaves so as to perform microwave-heating, a heater 11 used for heating by heater, a synchronous motor 5 for rotating the turntable 4, a housing light 12 for lighting up the inside of the housing 2, a buzzer 13 for sounding and a display 14 for indicating, for example, the termination of heating, and the like. A reference numeral 15 denotes a crystal oscillator externally attached, which generates control clock pulses of several hundred KHz in cooperation with the microcomputer 7.

Figure 3:
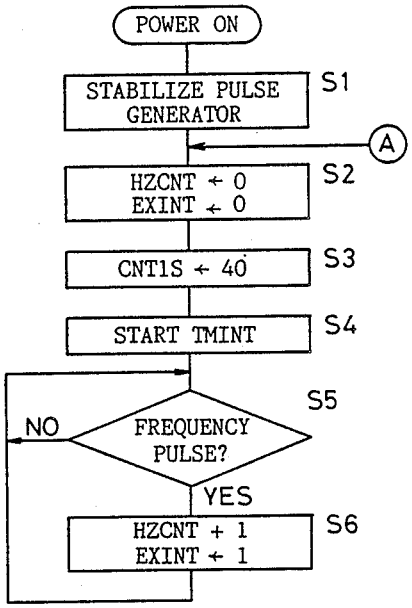
FIGS. 3(*a–d*) represent a flow chart showing the procedure of control of heating and control of the rotation of a turntable according to the first embodiment.
Figure 3:
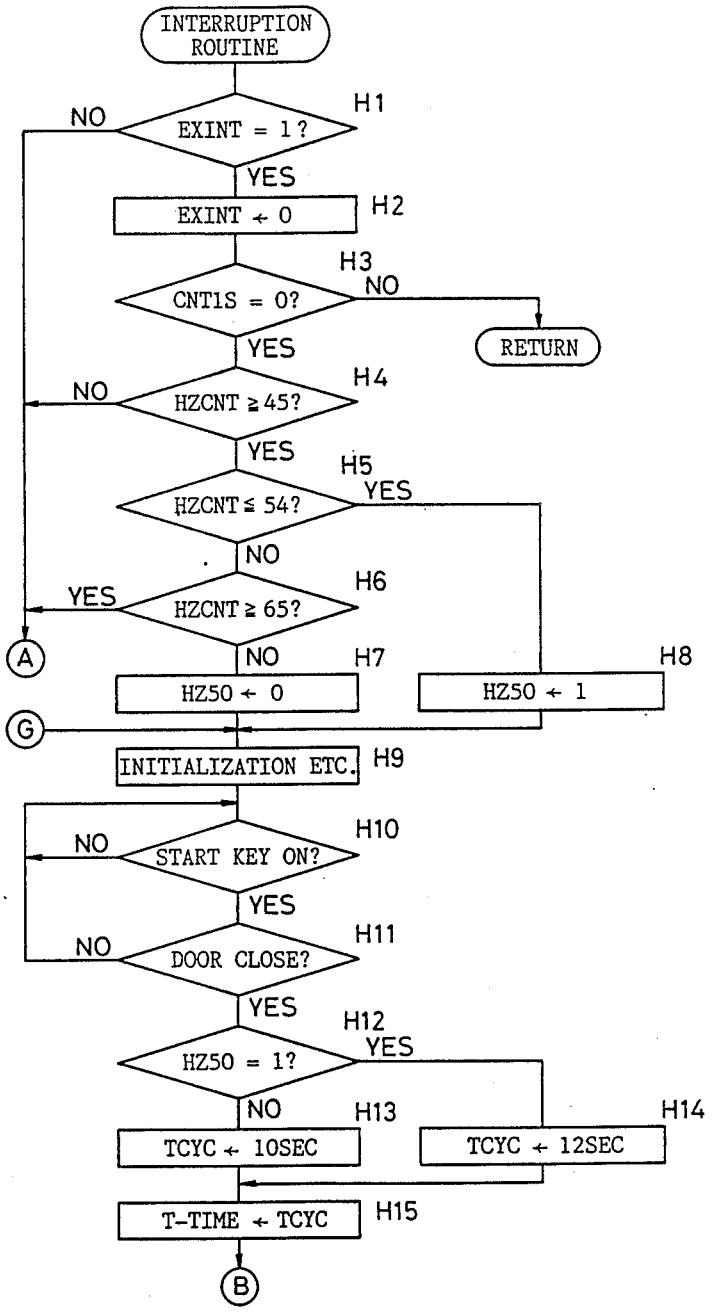
Figure 3:
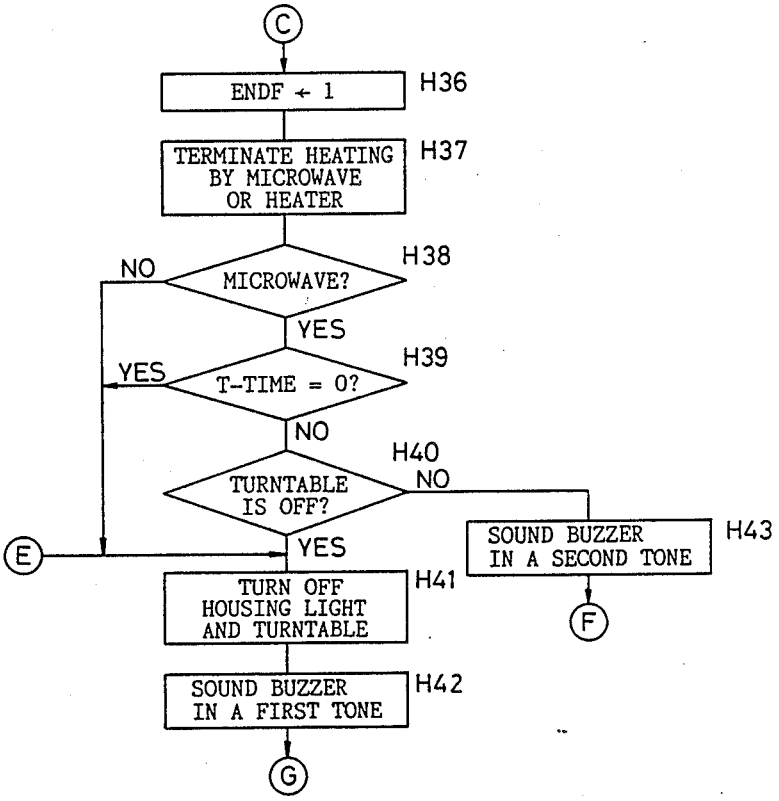

FIGS. 3(*a–d*) represent a flow chart showing a control program of the microcomputer 7. An operation of the microwave oven will be described in detail along the flow chart.

Description is now made with reference to FIG. 3(*a*). In the step S1, the microcomputer 7 waits until an operation of the pulse generator 10 is stabilized in response to the application of the power supply. The steps S2, S3 and S4 are sequentially executed after time when it is considered that the pulse generator 10 was stabilized.

In the step S2, both a frequency counter HZCNT and a frequency pulse interruption flag EXINT in the microcomputer 7 are reset. In the step S3, time is set in a one-second counter CNT1S in the microcomputer 7. In the step S4, an interruption timer TMINT in the microcomputer 7 begins to repeatedly count 25 milliseconds in response to the control clock pulses.

Thereafter, the steps S5 and S6 are executed in a circulating manner In the step S5, it is determined whether or not a frequency pulse is inputted in an interrupted manner from the pulse generator 10. In this case, the frequency pulse is inputted for every approximately 16.7 milliseconds (1/60 seconds) when the frequency of the power supply is 60 Hz while being inputted for every approximately 20 milliseconds (1/50 seconds) when it is 50 Hz. When the frequency pulse is inputted, the step S6 is executed. In the step S6, the frequency counter HZCNT is incremented by one and the interruption flag EXINT is set.

During the execution of the steps S5 and S6 in a circulating manner, the one-second counter CNT1S is decremented by one (the step is not shown) and an interruption routine is carried our every time the interruption timer TMINT repeatedly counts 25 milliseconds.

Description is now made with reference to FIG. 3(*b*). First, in the step H1, it is determined whether or not the interruption flat EXINT is set. If frequency pulses are normally generated, a frequency pulse having a cycle shorter than 25 milliseconds is always generated once while the interruption time TMINT counts 25 milliseconds, so that the interruption flat EXINT is set in the step S6. Accordingly it is determined in the step H1 that the interruption flag EXINT is set, that is, EXINT=1. On the other hand, if a state in which frequency pulses are generated is still unstable after the execution of the step S1 so that no frequency pulse is generated while the interruption timer TMINT counts 25 milliseconds, the interruption flag EXINT is not set. Accordingly, it is determined that frequency pulses are unstably generated. Consequently, the step S2 and the subsequent steps are executed again.

If it is determined in the step H1 that the interruption flag EXINT is set, the interruption flag EXINT is then reset in the step H2.

In the subsequent step H3, it is determined whether or not the contents of the one-second counter CNTIS are zero. In this case the contents of the one-second counter CNT1S are not zero. Accordingly, the steps S5 and S6 are executed again in a circulating manner.

In the above described manner, during the execution of the steps S5 and S6 in a circulating manner, the contents of the frequency counter HZCNT are counted up by one every time a frequency pulse is generated and the contents of the one-second counter CNTIS are counted down by one every time the interruption timer TMINT repeatedly counts 25 milliseconds.

When time is set in the one-second counter CNT1S in the step S3 is counted down for each 25 milliseconds in accordance with the above described counting and the contents of the one-second counter CNT1S become zero after an elapse of one second (=40 ×25 milliseconds), the steps H4, H5 and H6 are suitably executed.

In the steps H4, H6 and H6, it is determined whether the contents of the frequency counter HZCNT are 45 or more, 54 or less or 65 or more. In this case, that is, immediately after one second has elapsed, the contents of the frequency counter HZCNT are approximately 60 when the frequency of the power supply is 60 Hz. Consequently, the step H7 is executed.

If the frequency of the power supply is 50 Hz, the contents of the frequency counter HZCNT are approximately 50. Accordingly, the step H8 is executed after the steps H4 and H5.

A frequency flag HZ50 is reset to zero in the step H7 so as to indicate that the frequency of the power supply is 60 Hz while being set to one in the step H8 so as to indicate that it is 50 Hz.

If the contents of the frequency counter HZCNT are less than 45 or 65 or more for one cause or another it is considered that an error occurs. Consequently, the program sequence proceeds to the step S2 after the step H4 or H6, so that the step S2 and the subsequent steps are executed again.

After it is determined in the above described manner whether the frequency of the power supply is 60 Hz or 50 Hz, the step H9 is executed. In the step H9, various rewritable memories other than the frequency flag HZ50 in the microcomputer 7 are initialized and each of outputs of the microcomputer 7 is turned off.

Thereafter, it is determined in the step H10 whether or not a start key is operated in the keyboard 8.

Description is now made of a case of time-heating by microwave. When an operator sets heating time by microwave and operates the start key in the keyboard 8, the step H11 is executed after the step H10. In the step H11, it is examined by the door switch 9 whether or not the door 2a is closed. When the door 2a is closed, the frequency flag HZ50 is then examined in the step H12. On this occasion, the step H13 is executed when the frequency flag HZ50 is reset to indicate that the frequency of the power supply is 60 Hz, while the step H14 is executed when the frequency flag HZ50 is set to indicate that the frequency of the power supply is 50 Hz.

In the steps H13 and H14, time required for the turntable 4 driven by the synchronous motor 5 to rotate once is set in a turntable cycle timer TCYC in the microcomputer 7. The time required for the turntable 4 to rotate once is 10 seconds when the frequency of the power supply is 60 Hz while being 12 seconds when it is 50 Hz. Accordingly, 10 seconds is set in the turntable cycle timer TCYC in the step H13, while 12 seconds is set therein in the step H14.

In the step H15, the contents of the turntable cycle timer TCYC, that is, the time required for the turntable 4 to rotate once is stored in a turntable timer T-TIME in the computer 7. In this case, the contents of the turntable cycle timer TCYC are not cleared.

Description is now made with reference to FIG. 3(*c*). In the step H16, a heating interruption flag INT in the computer 7 is reset. In the step H17, it is determined whether or not heating to be performed is microwave-heating. If heating is microwave-heating, the step H18 is executed. In the step H18, it is determined whether or not a turntable stop flag TTOFF in the computer 7 is set. In the case of microwave-heating, the turntable stop flag TTOFF is normally reset. Accordingly, it is determined in the step H18 that the answer is in the negative. Consequently, the program sequence proceeds to the step H19.

In the step H19, the commercial power supply is applied to the synchronous motor 5, so that the turntable 4 begins to rotate. Thereafter, the program sequence proceeds to the step H20. If it is determined in the step H18 that the answer is in the affirmative, the program sequence directly proceeds to the step H20.

In the step H20, the magnetron is driven, so that microwave-heating is started.

In the step H21, the housing light 12 begins to be turned on.

Thereafter, the steps H22 to H28 are executed in a circulating manner.

In the step H22, the turntable timer T-TIME is decremented every time one second has elapsed in response to the frequency pulses from the pulse generator 10.

In the step H23, it is determined whether or not the contents of the turntable timer T-TIME are zero. If the answer is in the negative, the program sequence proceeds to the step H24.

It is determined in the step H24 whether or not a heating end flag ENDF in the computer 7 is set, it is determined in the step H25 whether or not the heating interruption flag INT is set, and it is determined by the door switch 9 in the step H26 whether or not the door 2*a* is opened. In the step H27, on-off control of microwave-heating started in the step H20 is performed a required. In the step H28, it is determined whether or not the microwave-heating is to be terminated.

During the execution of the steps H22 to H28 in a circulating manner, the program sequence is returned to the step H24 after bypassing the steps H29 to H33 from the step H23 every time the turntable 4 rotates once so that a value set in the turntable timer T-TIME becomes zero.

The step H29 is the same as the step H15. In the step H29, the time required for the turntable 4 to rotate once is set again in the turntable timer T-TIME.

The steps H30 and H31 are respectively the same as the steps H24 and H25.

In the step H32, it is determined whether or not heating time is set in the current microwave-heating. The heating time is currently set as described above.

In the step H33, it is determined whether or not the remaining heating time is one-half or less of the time required for the turntable 4 to rotate once which is set in the turntable cycle timer TCYC. The answer is in the negative in the step H33 when the remaining heating time is one-half or more of the time required for the turntable 4 to rotate once, while the steps H34 and H35 are subsequently executed when the remaining heating time becomes one-half or less of the time required for one rotation of the turntable 4.

The turntable stop flag TTOFF is set in the step H34, and the application of the power supply to the synchronous motor 5 is stopped, so that the rotation of the turntable 4 is stopped in the step H35. More specifically, when the remaining heating time is short, i.e., one-half or less of the time required for one rotation of the turntable 4, the rotation of the turntable 4 is stopped, to continue only heating.

Thereafter, the steps H22 to H28 are executed in a circulating manner. When the remaining heating time is zero, that is, when the microwave-heating is to be terminated, the steps H36 and 37 are executed after the step H28.

Description is now made with reference to FIG. 3(*d*). In the step H36, the heating end flag ENDF is set. In the step H37, driving of the magnetron 1 is stopped so that the microwave-heating is terminated. In the next step H38, it is determined whether or not the heating performed is microwave-heating. In this case, heating is microwave-heating. Accordingly, the step H39 is executed.

In the step H39, it is determined whether or not the contents of the turntable timer T-TIME are zero. In this case, the rotation of the turntable 4 has been stopped, while the turntable timer T-TIME is being decremented, the contents thereof being not zero. Consequently, the program sequence proceeds to the step H40. In the step H40, it is determined whether or not the turntable 4 has stopped. In this case, the turntable 4 has stopped. Consequently, the steps H41 and H42 are then executed. In the step H41, the housing light 12 is turned off. In the step H42, the buzzer 13 Sounds in a first tone.

Thereafter, the program sequence is returned to the step H9 and remains in the step H10 until the start key is operated for the next heating.

In the above described manner, control in the case of the time-heating by microwave is terminated. This control is summarized with reference to a timing chart of FIG. 4.

The rotation of the turntable 4 and lightning of the housing light 12 are started simultaneously with the start of heating. When the turntable 4 rotates several times, that is, rotates a natural number n of times and the remaining heating time becomes one-half or less of the time required for the turntable 4 to rotate once, the rotation of the turntable 4 is immediately stopped (see FIG. 4(*b*)). Thereafter, at the time point where the remaining heating time becomes zero, heating is terminated (see FIG. 4(*a*)). Consequently, the buzzer 13 sounds in the first tone and the housing light 12 is turned off (see FIG. 4(*c*)).

Accordingly, the food 3 can be quickly taken out for the following reason. If the turntable 4 is further rotated when the remaining heating time becomes one-half or less of the time required for the turntable 4 to rotate once, the turntable 4 rotates ½ turns or more after heating is terminated, so that the food 3 is taken out with further delay.

Description is made of a case in which the remaining heating time by microwave is less than the time required for one rotation of the turntable 4 but longer than one-half thereof, when the turntable 4 repeatedly rotates several times in the time-heating by microwave. The steps H22 to H28 are executed in a circulating manner again without passing through the steps H34 and H35 after bypassing the steps H29 to H33 from the step H23. Accordingly, the turntable 4 continues to rotate.

When the remaining heating time becomes zero, that is, the microwave-heating is to be terminated, the program sequence proceeds to the step H36 after the step H28 in the above described manner. The heating end flag ENDF is set in the step H36, and the time-heating by microwave is terminated in the step H37. Thereafter, it is examined in the step H39 whether or not the contents of the turntable timer T-TIME are zero. In this case, since the turntable timer T-TIME is being decremented, it is determined that the answer is in the negative. Consequently, the program sequence proceeds to the step H40. In the step H40, it is determined whether the turntable 4 is continued to rotate. Subsequently, the step H43 is executed. In the step H43, the buzzer 13 sounds in a second tone.

Thereafter, the steps H22 to H24 are executed in a circulating manner. During the circulation, when the contents of the turntable timer T-TIME become zero, the program sequence proceeds to the step H30 through the step H29. In the step H30, it is determined that ENDF=1. Consequently, the program sequence proceeds to the steps H41 and H42. In the step H41, the housing light 12 is turned off and the turntable 4 stops. In the step H42, the buzzer 13 sounds in the first tone.

Figure 5:
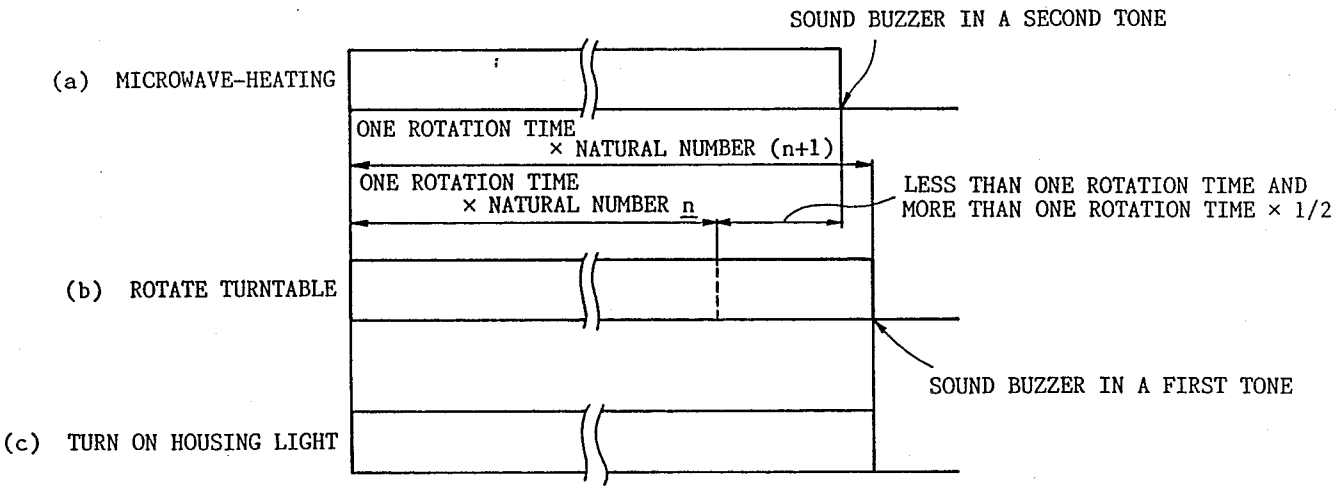

The control in this case is summarized with reference to a timing chart of FIG. 5. The rotation of the turntable 4 and lightning of the housing light 12 are started simultaneously with the start of heating. When the turntable 4 rotates a natural number n of times and the remaining heating time is less than the time required for the turntable 4 to rotate once but longer than one-half thereof, the turntable 4 still rotates. Thereafter, the heating is terminated at the time point where the remaining heating time becomes zero (see FIG. 5(*a*)) and the buzzer 13 sounds in the second tone. When the turntable 4 further rotates once after it rotates n times, that is, when the turntable 4 rotates a natural number (n+1) of times in total, the housing light 12 is turned off (see FIG. 5 (*c*)), and the turntable 4 stops and the buzzer 13 sounds in the first tone (see FIG. 5(*b*)).

Accordingly, the food 3 can be uniformly heated for the following reason. If the rotation of the turntable 4 is immediately stopped when the remaining heating time is less than the time required for the turntable 4 to rotate once and longer than one-half thereof, the rotation is stopped over a long time period which is one-half or more of the time required for one rotation of turntable 4. Consequently, it is difficulty to uniformly heat the food 3.

Figure 4:
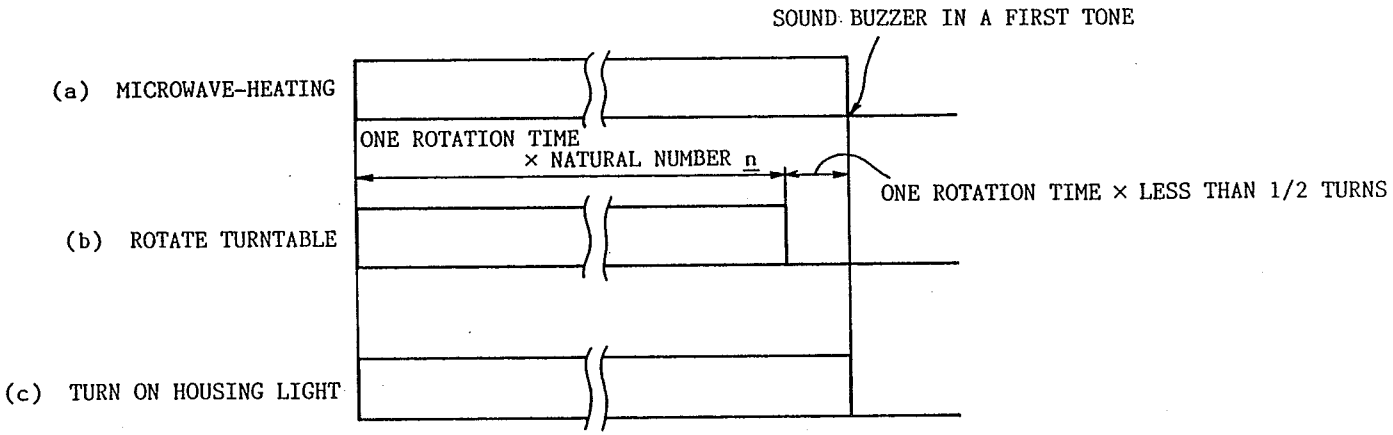
FIGS. 4 and 5 are timing charts showing a case of time-heating by microwave according to the first embodiment.

In either case of FIG. 4 and FIG. 5, time required to drive the turntable 4, that is, time required to energize the synchronous motor 5 becomes one which is a natural number n or (n+1) multiple of the time required for the turntable 4 to rotate once, so that the turntable 4 rotates n times or (n 30 1) times as described above. Accordingly, when the turntable 4 stops, the position, within the housing 2, of the food 3 placed on the turntable 4 is the same as that at the time when the rotation of the turntable 4 is started. More specifically, when the food 3 is placed on a forward position within the housing 2 the food 3 is similarly stopped in a forward position within the housing 2 when the rotation of the turntable 4 is stopped, so that the food 3 can be easily taken out.

Description is now made of control performed when the door 2*a* is opened or closed so as to, for example, confirm the state of heating during the time-heating by microwave.

During the execution of the steps H22 to H28 in a circulating manner, when it is detected in the step H26 that the door 2*a* is opened, the steps H44 and H45 are executed.

In the step H44, the heating interruption flag INT is set. In the step H45, driving of the magnetron 1 is stopped, so that the microwave-heating is interrupted.

Thereafter, the steps H22 to H25, H46 and H47 are executed in a circulating manner. In this circulation, it is determined in the step H46 whether or not the turntable 4 has stopped. In the step H47, it is determined whether or not the start key is operated in the keyboard 8.

During the circulation, when the contents of the turntable timer T-TIME become zero, that is, when the turntable 4 rotates a natural number $n_1$ of times, the steps H23 to H35 are executed through the steps H29 to H31. In the step H35, the turntable 4 stops. Accordingly, the food 3 is stopped in a forward position of the turntable 4, so that the state in which the food 3 is heated is easily confirmed.

Thereafter, the steps H24, H25, H46, H48, H47, H22 and H23 are executed in a circulating manner.

In such a state, when the operator closes the door 2*a* and operates the start key in the keyboard 8 after the state of heating is confirmed, the program sequence is returned to the step H16 from the step H47, so that the heating interruption flag INT is cleared. Thereafter, the rotation of the turntable 4 and the microwave-heating are resumed. After resumption thereof, the above described program sequence is repeated.

Description is now made of the procedure of control in the case of temperature-heating by microwave performed by setting the heating temperature.

The operator sets a desired heating temperature by microwave in the keyboard 8, and operates the start key. The steps H22 to H28 are executed in a circulating manner after the step H10 through each step in the above described manner. During this circulation, the program sequence proceeds to the steps H29 to H32 every time the turntable 4 rotates once so that the contents of the turntable timer T-TIME become zero.

It is determined in the step H32 whether or not an operation by time is performed. Since the temperature heating by microwave is currently selected, NO is selected in the step H32, so that the program sequence is returned to the step H24.

During this circulation, when the temperature of the food 3 sensed by, for example, a temperature sensor (not shown) reaches a desired heating temperature by microwave so that it is determined that it is time to terminate microwave-heating, YES is selected in the step H28. The heating end flag ENDF is set in the step H36, and the microwave-heating is terminated in the step H37. In the step H39 if the contents of the turntable timer T-TIME are not zero, the program sequence proceeds to the step H43 from H40. In the step H43, the buzzer 13 sounds in the second tone.

Thereafter, the steps H22 to H24 are executed in a circulating manner. When the contents of the turntable timer T-TIME become zero in the step H23, the steps H29 and H30 are executed. Since it is determined in the step H30 that the heating end flag ENDF is one, the program sequence proceeds to the steps H41 and H42. In the step H41, the housing light 12 is turned off and the turntable 4 stops. In the step H42, the buzzer 33 sounds in the first tone.

Figure 6:
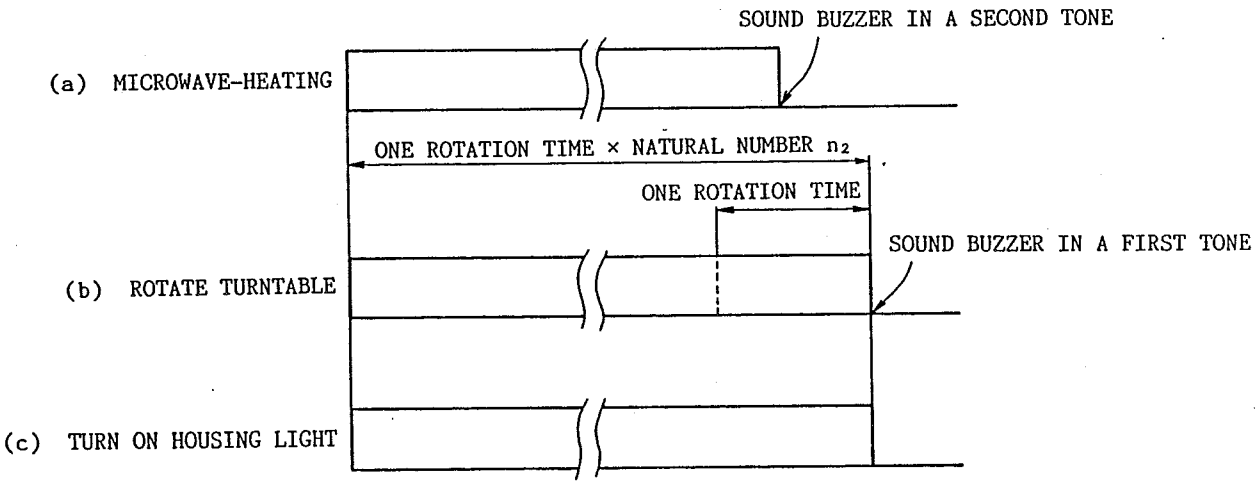
FIG. 6 is a timing chart showing a case of temperature heating by microwave according to the first embodiment.

Referring now to a timing chart of FIG. 6, description is made once again of control in the case of the foregoing temperature heating by microwave.

The rotation of the turntable 4 and lightning of the housing light 12 are started simultaneously with the start of heating. Heating is terminated at the time point where the temperature of the food 3 reaches a desired temperature, and at the same time the buzzer 33 sounds in the second tone (see FIG. 6(*a*)). Thereafter, when one rotation of the turntable 4 is completed, the housing light 12 is turned off (see FIG. 6(*c*)), the turntable 4 stops (see FIG. 6(*b*)), and the buzzer 13 sounds in the first tone. On this occasion, time T required to drive the turntable 4 is one which is a natural number $n_2$ multiple of the time required for the turntable 4 to rotate once.

An operation to occur when the door 2*a* is opened during the temperature heating by microwave is the same as that in the case of the time-heating by microwave.

Description is now made of a case of time-heating by heater.

A square pan where foods are placed is located within the housing 2. Heating time by heater is set using the keyboard 8 and the start key is operated. Consequently, the program sequence proceeds to the step H17 after the step H10 through every step and then, the step H49 is executed. In the step H49, the heater 11 is driven sO that heating by heater is started. The subsequent procedure is the same as that of the time-heating by microwave.

Embodiment 2

Description is now made of a second embodiment.

A microwave oven according to the above described first embodiment is adapted such that the turntable rotates approximately natural number of times in the microwave-heating such that the food placed on the turntable is in the same forward position when the microwave-heating is terminated.

Thus, the turntable rotates approximately a natural number of times. Accordingly, in situations where the turntable rotates for example 10.5 times at the time point where microwave-heating is terminated, the turntable rotates until it rotates a natural number of times, i.e., 11 times after the microwave-heating is terminated.

This same applies to heating by heater. The turntable rotates approximately a natural number of times after the heating by heater is terminated.

However, there is a case in which prior to the heating by heater, the inside of a housing is preheated and then, a food is placed on the turntable in the housing. In this case, if the procedure according to the first embodiment is employed, the turntable does not stop until it rotates a natural number of times even when the food is to be placed on completion of preheating.

Accordingly, even if the food is intended to be placed on the turntable immediately after preheating is completed, the food can not be placed until the turntable stops after it rotates a natural number of times, so that an operator must wait approximately several seconds.

Consequently, if the door 2*a* is operated to open the housing in order to place the food immediately after preheating is completed the inside of the housing preheated is rapidly cooled while the operator waits until the turntable stops.

The second embodiment is related to a microwave oven having a structure for rotating the turntable approximately a natural number of times at the time of control of heating and capable of increasing the speed of cooking by immediately stopping the turntable at the time of the termination of preheating such that an object such as a food can be easily placed.

In the present embodiment, the structure of the microwave oven is the same as that in the first embodiment (Refer to FIGS. 1(*a*) and 1(*b*)). It is assumed that the frequency of the commercial power supply is 60 Hz.

Figure 7:
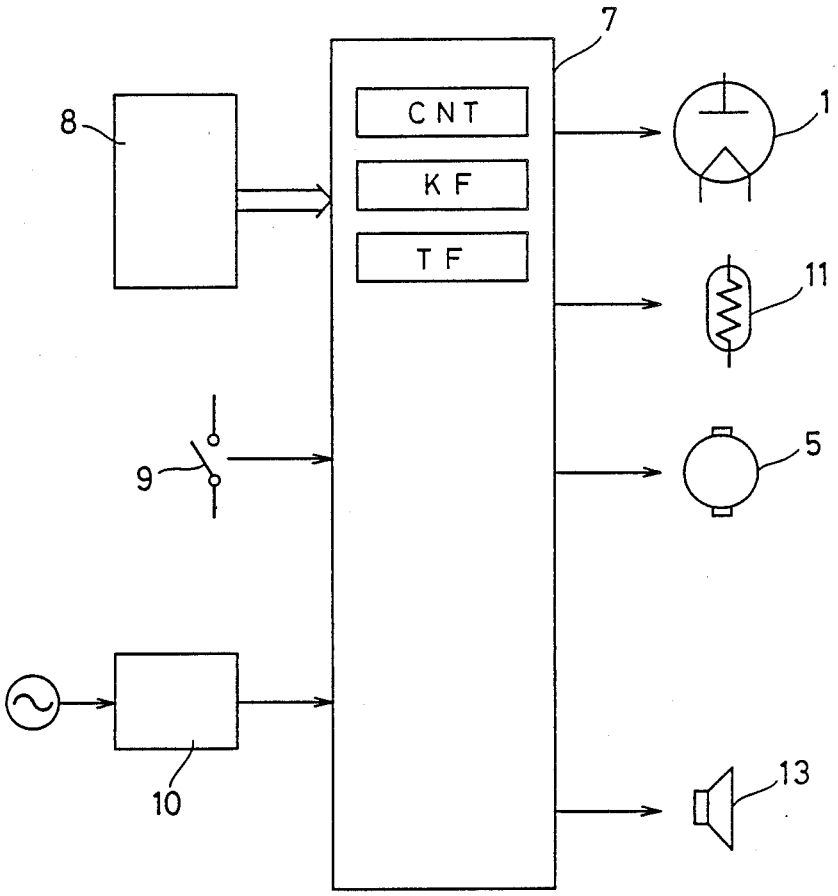
FIG. 7 is a diagram showing a circuit for controlling heating according to a second embodiment.

FIG. 7 illustrates a circuit for controlling heating of the microwave oven. Various desired signals are inputted to a microcomputer 7 for performing control of heating from a keyboard 8 for setting heating conditions or the like, a door switch 9 for turning on/off in response to the movement of a front door 2*a* for opening or closing a housing 2, a pulse generator 10 receiving the commercial power supply as an input so as to generate pulses having the same frequency as that of the commercial power supply, and the like. In addition, the microcomputer 7 is connected with a magnetron 1 for oscillating microwaves to perform microwave-heating, a heater 11 used for heating by heater, a synchronous motor 5 for rotating a turntable 4, a buzzer 13 for sounding, for example, the termination of heating, and the like.

Figure 8:
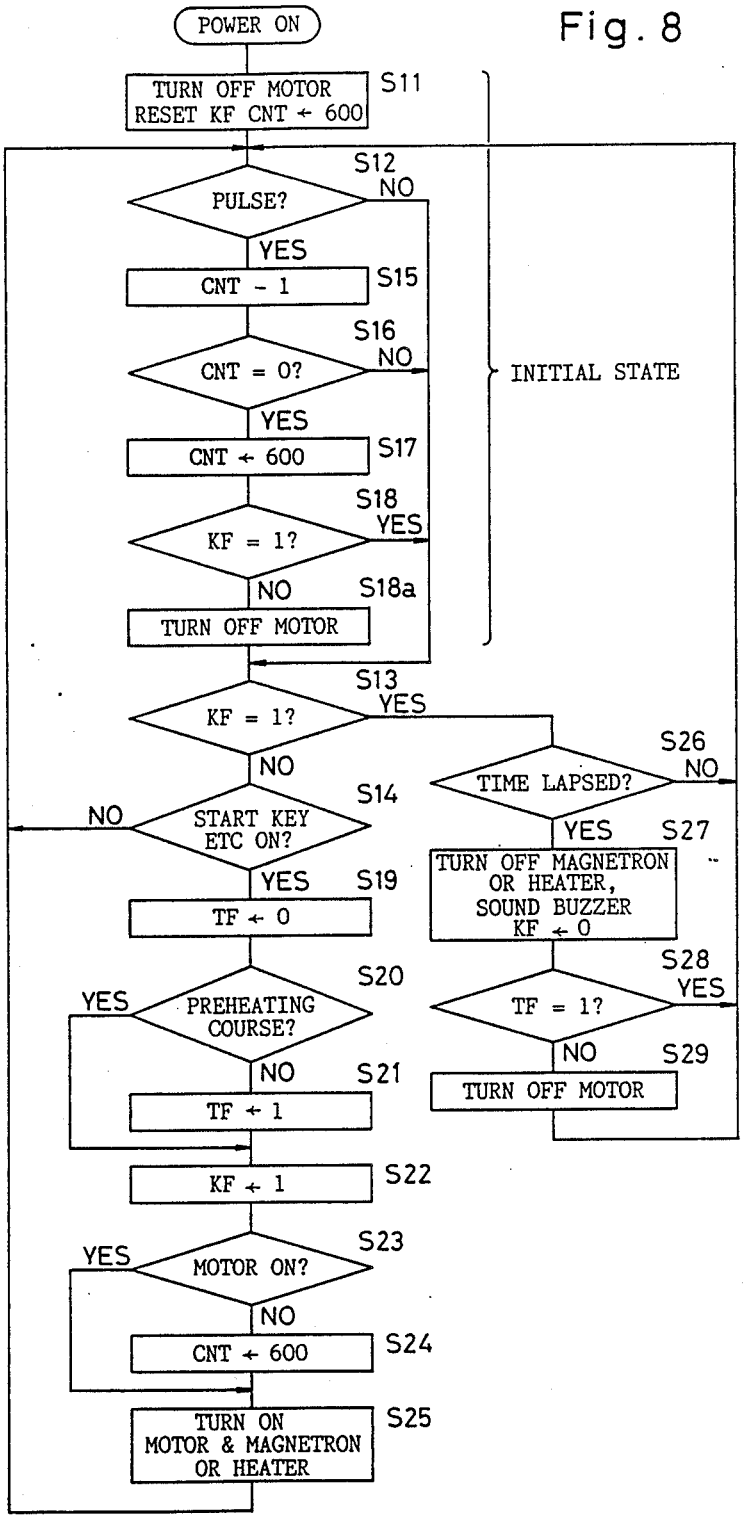
FIG. 8 is a flow chart showing the procedure of control of heating and control of the rotation of a turntable according to the second embodiment.

FIG. 8 is a flow chart of a control program executed by the microcomputer 7. An operation of the microwave oven will be described in detail along the same chart.

The step S11 is first executed in response to the application of the commercial power supply to the microwave oven. In the step S11, driving of the synchronous motor 5 is inhibited so that rotation of the turntable 4 is held still. In addition, an operation flag KF in the computer 7 is reset and 600 is set in a counter CNT in the computer 7.

In the step S12, it is determined whether or not a 60 Hz-pulse is generated from the pulse generator 10.

Setting of 600 in the counter CNT means that 10 seconds are counted because it follows that the 60 Hz-pulse is counted 600 times. On the other hand, when the frequency of the commercial power supply is e.g. 60 Hz, time required for one rotation of the turntable 4 is 10 seconds. Accordingly, time required for the counter CNT to count 600 is equal to the time required for one rotation of the turntable 4.

If it is determined in the step S12 that the answer is in the negative, the step S13 is executed. In the step S13, it is determined by the operation flag KF whether or not heating is being currently performed. In this case, the operation flag KF is in a reset state, so that it is determined that heating is not being performed.

Subsequently, the step S14 is executed. In the step S14, it is determined whether or not the door switch 9 is turned on by closing the door 2*a*, heating conditions are set in the keyboard 8, and a start key is operated. In this case, such a series of works are not performed. Accordingly, the steps S12, S13 and S14 are then executed in a circulating manner.

During the circulation, when the 60 Hz-pulse is generated from the pulse generator 10, the step S15 is executed In the step S15, one is subtracted from the contents of the counter CNT.

In the step S16, it is determined whether or not the contents of the counter CNT after such subtraction become zero. If it is determined that the answer is in the negative, the steps S13 and S14 are sequentially executed. Thereafter, the steps S12, S13 and S14 or the steps S12, S15, S16, S13 and S14 are executed in a circulating manner until the contents of the counter CNT become zero.

During the circulations, if the contents of the counter CNT become zero, the step S17 is executed. In the step S17, 600 is newly set in the counter CNT. In the next step S18, the operation flag KF is examined, as in the step S13. Also in this case, if it is determined that the answer is in the negative, the program sequence is returned to the step S12 through the steps S18*a*, S13 and S14.

In the step S18*a*, if the turntable 4 already rotates, the application of the commercial power supply to the synchronous motor 5 is stopped, so that the rotation of the turntable 4 is stopped. The contents of the counter CNT are 600 when the program sequence is returned to the step S12, which is exactly the same as a case immediately after the power supply is turned on. Subsequently an operation performed immediately after the power supply is turned on and the subsequent operations are repeated. This state is hereinafter refered to as an initial state.

Meanwhile, when an operator places the food 3 on the turntable 4 in the housing 2 and closes the door 2*a* (the door switch 9 is turned on), sets a desired heating time by microwave and operates the start key in the keyboard 8 in order to control microwave-heating, the steps S19 is executed after the step S14. In the step S19, a one rotation flag TF in the computer 7 is reset.

In the step S20, it is determined whether or not a preheating course is to be taken. In this case, a preheating course is not taken. Accordingly, the step S21 is then executed. In the step S21, the one-rotation flag TF is set. In the step S22, the operation flag KF is set. In the step S23, it is determined whether or not the turntable 4 is rotating. If the turntable 4 is not rotating, 600 is set in the counter CNT in the step S24. In the step S25, the commercial power supply is applied to the synchronous motor 5 so that the turntable 4 begins to rotate and at the same time the magnetron 1 is driven so that microwave-heating is started.

Thereafter, the program sequence is returned to the step S12. If the pulse of 60 Hz is not generated from the pulse generator 10, the program sequence proceeds to the step S13. After the step S13, the step S26 is executed.

In the step S26, it is determined whether or not heating time or the like has elapsed. In this case, the heating time or the like has not elapsed yet, so that the program sequence is returned to the step S12. Accordingly, the steps S12, S13 and S26 are executed in a circulating manner.

During the above described circulation of the steps S12, S13 and S26, when the 60 Hz-pulse is generated from the pulse generator 10, the steps S13 and S26 are executed after the step S12 through the steps S15 and S16 (or the steps S15, S16, S17 and S18).

During such circulating execution, when the heating time by microwave has elapsed, YES is selected in the step S26 and then, the step S27 is executed.

In the step S27, driving of the magnetron 1 is stopped to terminate the microwave-heating, and the buzzer 13 sounds the termination of the heating. In addition, the operation flag KF is reset.

In the next step S28, it is determined whether or not the one-rotation flag TF is set. Since the one-rotation flag TF has been set in the step S21, YES is selected. Thereafter, the program sequence is returned to the step S12 and then, the steps S12, S13 and S14 are executed in a circulating manner while the 60 Hz-pulse is not generated from the pulse generator 10.

If the pulse of 60 Hz is generated, the steps S13 and S14 are executed after the step S12 through the steps S15 and S16. During this execution, when the contents of the counter CNT become zero, the step S18*a* is executed after the step S16 through the steps S17 and S18. In the step S18*a*, the application of the commercial power supply to the synchronous motor 5 is stopped so that the rotation of the turntable 4 is stopped. Thereafter, the initial state is executed.

To summarize the foregoing, the commercial power supply is applied to the synchronous motor 5 simultaneously with the start of the microwave-heating, so that the turntable 4 begins to rotate. On this occasion, the contents of the counter CNT are 600 (in the step S24). During heating, subtraction from 600 is repeated in the counter CNT. Considering a case in which the contents of the counter CNT are not zero by the subtraction when the heating is terminated in the step S27, the commercial power supply continues to be applied to the synchronous motor 5 so that the turntable 4 continues to rotate until the contents of the counter CNT become zero. When the contents of the counter CNT become zero, the rotation of the turntable 4 is stopped. Thus, the turntable 4 rotates simultaneously with the heating. The rotation of the turntable 4 is stopped when the counter CNT counts 600 a natural number of times.

The fact that the counter CNT counts 600 a natural number of times means that the turntable 4 rotates a natural number of times. The turntable 4 stops after it rotates a natural number of times. Accordingly, when the food 3 is placed in a forward position within the housing 2, the food 3 is also in the forward position within the housing 2 when the heating is terminated, so that the food is easily taken out.

Description is now made of control in the case of heating by heater. The operator places the food 3 on the turntable 4 in the housing 2 and closes the door 2*a* (the door switch 9 is turned on), then sets a desired heating time by heater and operates the start key in the keyboard 8. The control in this case of the heating by heater is almost the same as the control in the case of the microwave-heating except that the heater 11 is driven in place of the magnetron 1 so that the heating by heater is started in the step S25 and the heating by heater is terminated in the step S27.

Accordingly, in the same manner, the turntable 4 stops after it rotates a natural number of times, so that the food is easily taken out.

The main point of foregoing control is that the turntable 4 is stopped after being rotated a natural number of times, which is partially common to that of the first embodiment.

The advantages of the second embodiment are as follows.

Description is made of the procedure of control performed when the inside of the housing 2 is preheated and then, the food 3 is placed on the turntable 4 within the housing 2 and is heated by heater.

First, the operator closes the door 2a with placing no food in the housing 2 (the door switch 9 is turned on), and sets a desired preheating time and a desired heating time by heater, and then operates the start key in the keyboard 8.

Consequently, the step S20 is executed through the step S19 after the initial state. In this step S20, it is determined that a preheating course is to be taken. Accordingly, the step S22 is executed skipping the step S21. Then, the steps S23, S24 and S25 are sequentially executed. In the step S25, the heater is driven, so that preheating of the inside of the housing 2 is started.

Thereafter, the steps S12, S13 and S26 are executed in a circulating manner. Every time the 60 Hz-pulse is generated, the steps S13 and S26 are executed after the step S12 through the steps S15 and S16 (or the steps S15, S16, S17 and S18).

During such circulating execution, when the preheating time has elapsed, driving of the heater 11 is stopped so that preheating is terminated and the buzzer 13 sounds the termination of preheating, in the step S27. In the subsequent step S28, it is determined that the one-rotation flag TF is not set (because the step S21 is skipped as described above so that the one-rotation flag TF is not set).

The step S29 is then executed. In the step S29, the application of the commercial power supply to the synchronous motor 5 is stopped. Accordingly, the rotation of the turntable 4 is immediately stopped when driving of the heater 11 is stopped (when preheating is terminated) irrespective of whether or not the turntable 4 rotated a natural number of times.

Consequently, the operator can open the door 2a and then, places the food 3 on the turntable 4 within the housing 2 immediately after preheating is terminated Thereafter, the initial state is executed. In this state, when the operator closes the door 2a and then, operates the start key in the keyboard 8 again, the heating by heater is performed after preheating (this procedure is the same as the above described procedure of control in the case of the heating by heater). On this occasion, the turntable 4 stops after it rotates a natural number of times, so that the food is easily taken out.

In the above described embodiment, preheating is terminated by an elapse of the previously set preheating time.

However, such a modification can be made that the door 2a is opened to turn off the door switch 9 at the time point where it is assumed that the preheating is performed and thus, it is considered that preheating is terminated when the door switch 9 is turned off. In this case, it is necessary not to examine the elapse of the preheating time but to examine whether or not the door switch 9 is turned off, in the step S26.

As described in the foregoing, the microwave oven according to the second embodiment is adapted so as to allow the turntable 4 to stop immediately after the termination of preheating on the condition that the turntable 4 rotates approximately a natural number of times under control of the heating. Accordingly, the operator need not wait until the turntable stops after it rotates a natural number of times. Consequently, a food can be placed on the turntable for driving for the next heating immediately after preheating is terminated. The inside of the housing preheated can be prevented from being cooled even if the door 2a is opened immediately after preheating is terminated.

Embodiment 3

Description is now made of a third embodiment.

In the second embodiment, at the time of microwave-heating or heating by heater (excluding preheating), when the position of the food is slightly beyond the position where the turntable 4 rotates a natural number of times at the time point where the heating has been terminated, the turntable rotates almost once after the heating is terminated. In the interval of rotation of the turntable, the operator must wait to take out the food, so that waiting time is felt long.

In the first embodiment, when the remaining heating time exceeds time corresponding to ½ rotation at the time point where the turntable has rotated a natural number of times, the turntable rotates almost ½ turns after heating is terminated. In this interval, the operator must wait to take out the food, so that waiting time is felt long.

A microwave oven according to the present embodiment is adapted such that a turntable is stopped more quickly.

More specifically, in the present embodiment, the rotation of the turntable is immediately stopped if the front point of the turntable at the time when the rotation of the turntable is started is located in a predetermined forward range of the turntable when the heating has been terminated.

A structure of the microwave oven is the same as that in the first embodiment (Refer to FIGS. 1(a) and (b)).

Figure 9:
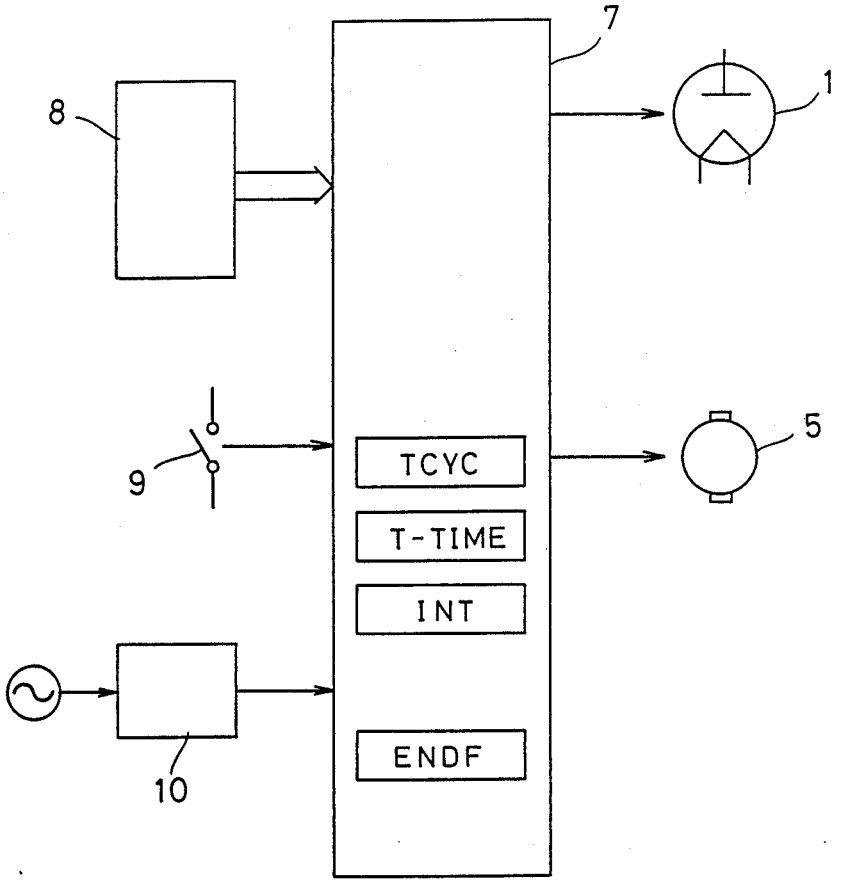
FIG. 9 is a diagram showing a circuit for controlling heating according to a third embodiment.

FIG. 9 illustrates a circuit of the microwave oven. A microcomputer 7 is provided as a control portion for controlling the microwave oven. Various desired signals are inputted to the microcomputer 7 from a keyboard 8 for setting heating conditions or the like, a door switch 9 for turning on/off in response to the opening or closing of a door 2a, a pulse generator 10 receiving the commercial power supply as an input for generating pulses having the same frequency as that of the commercial power supply, and the like. The microcomputer 7 supplies control signals to a magnetron 1 for oscillating microwaves so as to perform microwave-heating, a synchronous motor 5 for rotating the turntable 4, and the like.

If the contents of the frequency counter HZCNT are less

Figure 10A:
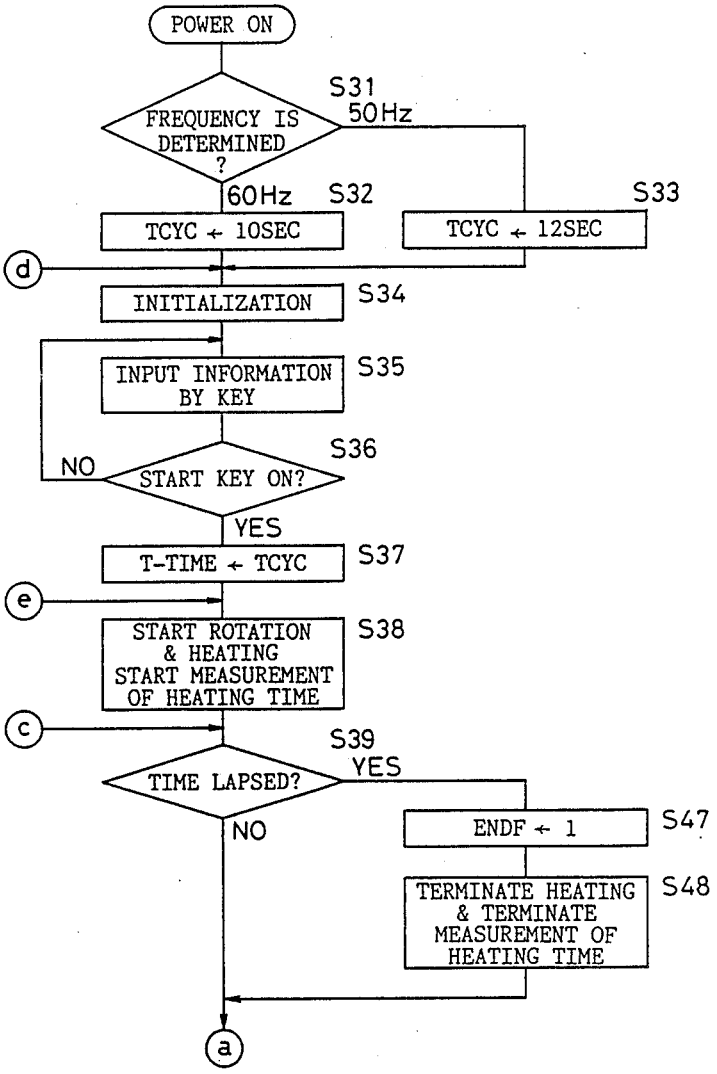
FIGS. 10(*a*) and 10(*b*) represent a flow chart showing the procedure of control of heating and control of the rotation of a turntable according to the third embodiment.
Figure 10:
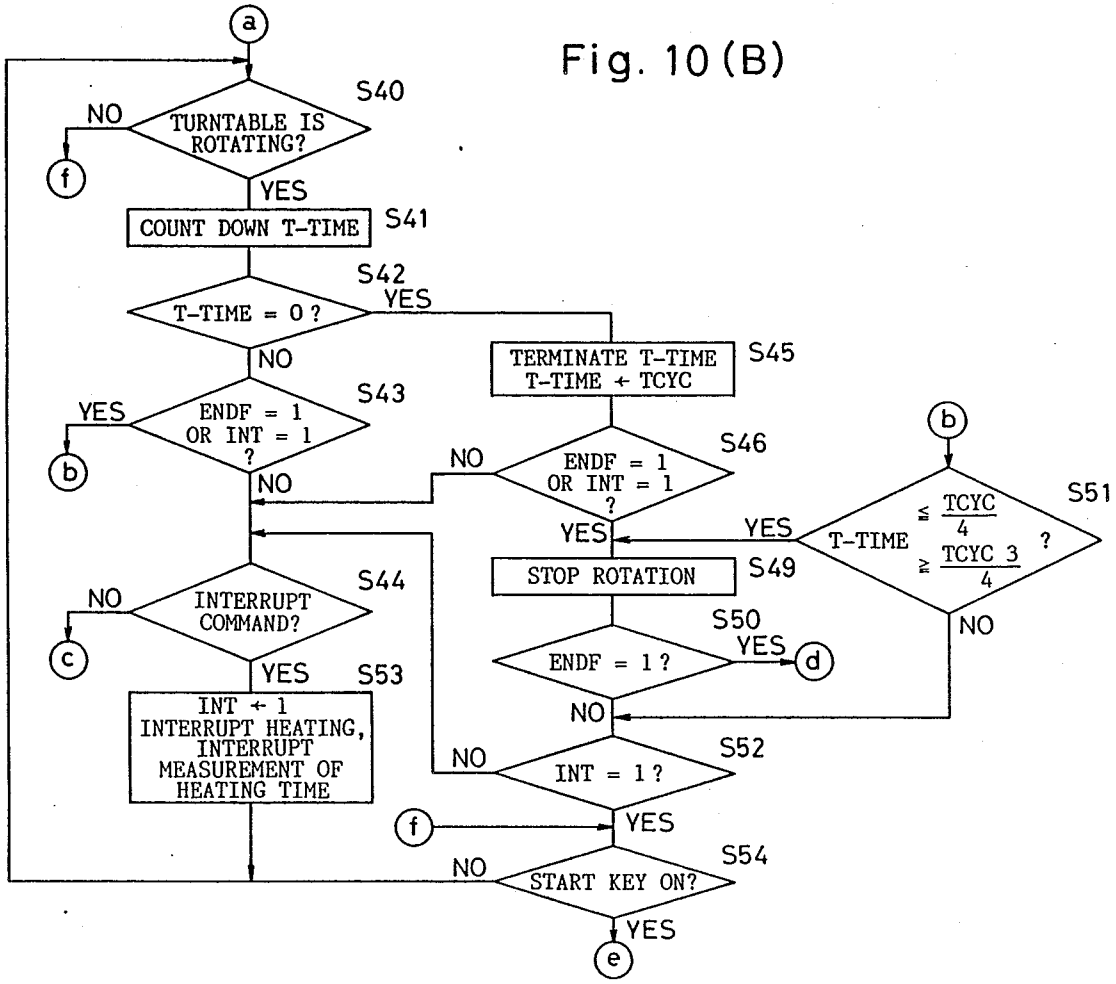

FIG. 10 illustrates the flow of a control program incorporated in the microcomputer 7. An operation of the microwave oven will be described in detail along FIG. 10.

The step S31 is first executed in response to the application of the commercial power supply to the microwave oven. In the step S31, it is determined whether the frequency of the power supply is 50 Hz or 60 Hz in response to the pulses from the pulse generator 10.

The step S32 is executed when it is determined in the step S31 that the frequency of the power supply is 60 Hz, while the step S33 is executed when it is determined that it is 50Hz. In the steps S32 and S33, time required for the turntable 4 to rotate once is set in a turntable cycle timer TCYC in the computer 7.

The synchronous motor 5 has the property that the rotational speed thereof is constant when the frequency of the commercial power supply applied thereto is constant. The time required for the turntable 4 to rotate once becomes constant. In this case, the time required for the turntable 4 to rotate once is 10 seconds when the frequency of the power supply is 60 Hz while being 12 seconds when it is 50 Hz. Accordingly, 10 seconds and 12 seconds are respectively set in the turntable cycle timer TCYC corresponding to 60 Hz and 50 Hz in the steps S32 and S33.

Thereafter, the step S34 is executed and then, the steps S35 and S36 are executed in a circulating manner.

In the step S34, all rewritable regions, other than the turntable cycle timer TCYC, in the compute 7 are initialized.

In the case of time-heating by microwave, an operator places a food 3 on the turntable 4 and closes the door 2a, and sets desired heating time by microwave in the keyboard 8. In the step S35, information set in the keyboard 8 is inputted.

In the step S36, it is determined whether the start key is operated in the keyboard 8. When the start key is operated, the steps S37 and S38 are then executed.

In the step S37, the contents of the turntable cycle timer TCYC, i.e., the time required for the turntable 4 to rotate once is stored in a turntable timer T-TIME in the computer 7. In this case, the contents of the turntable cycle timer TCYC are not cleared.

In the step S38, the commercial power supply is applied to the synchronous motor 5 so that the turntable 4 begins to rotate, and the magnetron 1 is driven so that the food 3 begins to be heated by microwaves. On this occasion, the food 3, which is rotated by the turntable 4, is uniformly heated. In addition, measurement of time elapsed since a start of heating is initiated.

In the step S39, it is determined whether or not the time elapsed since start of heating, whose measurement is started in the step S38, reaches the desired heating time by microwave. If the time elapsed since start of heating does not reach the heating time by microwave, the steps S39 to S44 are executed in a circulating manner.

In the step S40, it is determined whether or not the turntable 4 is rotating. In the step S41, the contents of the turntable timer T-TIME begins to be decremented. In the step S42, it is determined whether or not the contents of the turntable timer T-TIME become zero. In the step S43, it is determined whether or not at least one of a heating end flag ENDF and a heating interruption flag INT in the computer 7 is set. In the step S44, it is determined whether or not a heating interrupt command is generated by, for example, opening the door 2a to turn on the switch 9 or operating a stop key in the keyboard 8.

In the above described execution of the steps S39 to S44 in a circulating manner, when the turntable timer T-TIME continues to be decremented so that the contents thereof become zero, the steps S45, S46 and S44 are executed after the step S42.

In the step S45, an operation for decrementing the turntable timer T-TIME is terminated, so that the contents of the turntable cycle timer TCYC are stored again in the turntable timer T-TIME. In this case, the contents of the turntable cycle timer TCYC are not cleared.

In the step S46, which is the same as the step S43, it is determined whether or not at least one of the heating end flag ENDF and the heating interruption flag INT is set. In this case, the answer is in the negative, the program sequence proceeds to the step S44. In the step S44, it is determined whether or not the heating interrupt command is generated. If the heating interrupting command is not generated, the steps S39 to S44 are executed again in a circulating manner. Thereafter, during the execution of the steps S39 to S44 in a circulating manner, the steps S45 and S46 are executed every time the contents of the timer T-TIME become zero.

Heating proceeds while such a state is continued. When it is determined that the time elapsed since start of heating, whose measurement was started, reaches the desired heating time by microwave, the circulating execution is ended in the step S39 Subsequently, the steps S47 and S48 are executed.

In the step S47, the heating end flag ENDF is set. In the step S48, measurement of the time elapsed since start of heating is terminated and the measured time is cleared, and driving of the magnetron 1 is stopped so that the microwave-heating is terminated.

Thereafter, the steps S40, S41 and S42 are executed. In the step S42, it is determined whether or not the contents of the turntable timer T-TIME are zero. If it is determined that the contents of the turntable timer are zero, it follows that the timer T-TIME counts down the time required for one rotation of the turntable 4 a natural number of times. Thereafter, the steps S45 and S46 are executed. In the step S46, it is determined whether or not the heating end flag ENDF is set. In this case, the answer is in the affirmative. Consequently, the steps S49 and S50 are then executed.

In the step S49, the application of the power supply to the synchronous motor 5 is stopped, so that the rotation of the turntable 4 is immediately stopped. In the step S50, it is determined whether or not the heating end flag ENDF is set. In this case, the heating end flag ENDF is set in the step S47, so that YES is selected. Thereafter, the program sequence is returned to the step S34. The steps S35 and S36 are executed in a circulating manner. During this execution, the microcomputer waits for a key operation for the next heating.

To summarize the foregoing, the turntable 4 stops in a state in which it has just rotated a natural number of times simultaneously with the termination of heating. Accordingly, when the food 3 is placed in a forward position on the turntable 4 within the housing 2 for heating, the food 3 is also in the same forward position within the housing 2 when the rotation of the turntable 4 is stopped. Consequently, the food 3 is easily taken out from the turntable 4.

When the contents of the turntable timer T-TIME are not zero at the time of the termination of the microwave-hearing heating, the steps S47, S48 and S40 to S42 are executed and then, NO is selected in the step S42. Consequently, the program sequence proceeds to the step S43.

In the step S43, since the heating end flag ENDF is set, the step S51 is then executed after the step S43. In the step S51, it is determined whether the contents of the turntable timer T TIME are one-fourth or less or three-fourths or more of the contents of the turntable cycle timer TCYC. This determination corresponds to the determination as to whether the turntable 4 further rotates in the range of $\frac{1}{4}$ times or less, or $\frac{3}{4}$ times or more after it rotates an arbitrary natural number of times. The above described reference numerals $\frac{1}{4}$ and $\frac{3}{4}$ are shown by way of example. The other reference numerals, for example, $\frac{1}{8}$ and $\frac{7}{8}$ can be applied. In general, reference numerals a and (1-a) can be respectively applied on condition that $0<a\leqq\frac{1}{4}$.

In this case, if the contents of the turntable timer T-TIME are one-fourth or less or three-fourths or more of the contents of the turntable cycle timer TCYC, YES is selected in the step S51. Consequently, the step S49 is executed. In the step S49, the rotation of the turntable 4 is immediately stopped.

Figure 11:
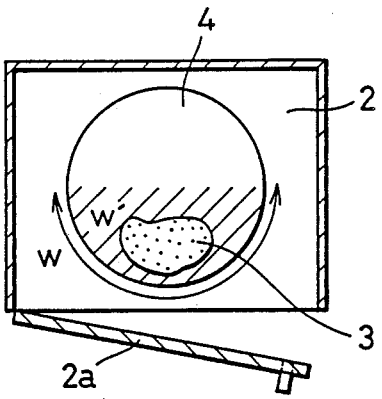
FIG. 11 is a cross sectional plan view showing a housing of a microwave oven.

To summarize the foregoing, when the contents of the turntable timer T-TIME are one-fourth or less, or three-fourths or more of the contents of the turntable cycle timer TCYC, the front point of the turntable 4 at the time when the turntable 4 is started to rotate (the time when heating is started) will be in any point in a forward half portion (in the range represented by an arrow W in FIG. 11) on the circumference of the turntable 4 after the turntable 4 rotates a natural number of times and further rotates ¼ times or less, or ¾ times or more. Accordingly, if the food 3 is placed in the forward portion close to the front point on the turntable 4 before heating, the food 3 is stopped in the forward half portion (in the range represented by hatching W' in FIG. 11) on the turntable 4. The food 3 is not in the same position as that at the time when it is placed. However, the food 3 can be taken out from the forward half position on the turntable 4, so that the food 3 is easily taken out.

Thus, even if the turntable 4 rotates an arbitrary natural number of times and further rotates ¼ times or less or, ¾ times or more at the time point where heating is terminated, the rotation thereof is stopped at that time point, so that the food 3 can be quickly taken out.

When it is determined in the step S51 that the answer is in the negative, the step S52 is then executed. In the step S52, it is determined whether or not the heating interruption flag INT is set. In this case, the heating interruption flag INT is not set. Consequently, the step S44 is then executed. Thereafter, the steps S39, S47, S48, S40, S41, S42, S43, S51, S52 and S44 are executed in a circulating manner. During this execution, the turntable 4 continues to rotate. If it is determined in the step S51 that the answer is in the affirmative as a result of the continuation of rotation, the rotation of the turntable 4 is stopped as already described in the foregoing.

Then, when during heating, the heating is interrupted so as to confirm a state in which the food 3 is heated, the door 2a is opened or the stop key is operated in the keyboard 8. Consequently, the circulating execution of the steps S39 to S44 is terminated in the step S44 and then, the step S53 is executed.

In the step S53, the heating interruption flag INT is set, and measurement of the time elapsed since start of heating is interrupted, and driving of the magnetron 1 is stopped so that the microwave-heating is interrupted. The program sequence is returned again to the steps S40, S41 and S42. However, if the contents of the turntable timer T-TIME are just zero in the step S42, the steps S45, S46, S49, S50, S52 and S54 are executed once in a circulating manner. Accordingly, the rotation of the turntable 4 is immediately stopped.

Thereafter, the steps S54 and S40 are executed in a circulating manner.

If the contents of the turntable timer T-TIME are not zero in the above described step S42, the program sequence proceeds to the steps S43 and S51. In the step S51, it is determined whether the contents of the timer T-TIME are one-fourth or less or three-fourths or more of the contents of the turntable cycle timer TCYC. If the answer is in the affirmative, the steps S49, S50, S52 and S54 are executed once in a circulating manner. On this occasion, the rotation of the turntable 4 is also immediately stopped. Thereafter, the steps S40 and S54 are executed in a circulating manner.

If the contents of the turntable timer T-TIME are neither one-fourth or less nor three-fourths or more of the contents of the turntable cycle timer TCYC, the program sequence proceeds to the steps S52 and S54 after the step S51. Thereafter, the steps S40, S41, S42, S43, S51, S52 and S54 are executed. If it is determined in the step S51 that the answer is in the affirmative, the rotation of the turntable 4 is stopped in the step S49. Thereafter, the program sequence proceeds to the steps S50, S52 and S54. Consequently, the steps S40 and S54 are executed in a circulating manner.

As described in the foregoing, even when during heating, the heating is forced to be interrupted, it is found that timing of stopping of the rotation of the turntable 4 is the same as that at the time of the termination of heating. Accordingly, a state in which the food 3 is cooked can be considerably observed. If necessary, the food 3 can be easily taken out.

When the door 2a is closed and the start key is operated again after the state of the food 3 is confirmed during the execution of the steps S40 and S54 in a circulating manner, it is determined in the step S54 that the start key is operated in the keyboard 8. Thereafter, the step S38 and subsequent steps are executed. Accordingly, the remaining heating is performed. An operation of the turntable 4 on this occasion is as already described above.

As described in the foregoing, in the third embodiment, if the turntable does not stop in the same position as that at the time when the food is placed, the turntable stops in the vicinity thereof at the time point where heating is terminated. Consequently, the food can be taken out in a forward position of the turntable 4. Accordingly, the food is substantially easily taken out.

Having described the present invention in detail with reference to the accompanying drawings, the present invention is not limited to the above described particular embodiments. For example, the control in the present invention can be also applied to other electric apparatuses such as a dryer.

It should be understood that various modifications may be made without departing from the scope of the present invention.

What is claimed is:

1. An electric apparatus powered by a power supply, comprising:

a housing;

a turntable arranged in the housing for rotating an object to be placed thereon;

driving means for driving said turntable;

controlling means for controlling the driving of said driving means, said controlling means comprising:

first means for determining and storing a first time period which is the time period required for one rotation of the turntable;

second means communicating with said first means and for determining whether a time period, which is approximately a natural number multiple of the first time period, has elapsed since the rotation of said turntable was started;

third means for stopping said driving means from driving said turntable; and fourth means for communicating with said second and third means and for conditioning the activation of said third means on the basis of a determination that a time period, which is approximately a natural number multiple of said first time period, has elapsed.

2. An electric apparatus according to claim 1, wherein said driving means includes a synchronous motor.

3. An electric apparatus according to claim 2, wherein said first means relies on the frequency of the power supply for determining the time required for one rotation of the turntable.

4. An electric apparatus according to claim 2, further comprising input means for setting a predetermined heating period, and wherein said controlling means further comprises:

fifth means for measuring the time remaining in said heating period; and sixth means for comparing, at a time period which is approximately a natural number multiple of said first time period, the time measured by said fifth means to a second time period equal to one-half of said first time period, said sixth means further including means for immediately activating said third means when the time measured by said fifth means is less that or equal to said second time period and for subsequently activating, after a time period essentially equal to said first time period, said third means when said time measured by said fifth means is greater than said second time period and less than said first time period.

5. An electric apparatus having a turntable according to claim 2, wherein said housing has a door, said control means further comprising means for determining when said door is opened during the rotation of said turntable and for activating said third means at a time when both said door is opened and said second means determines a time period has elapsed which is approximately a natural number multiple of said first time period.

6. An electric apparatus according to claim 2, which further comprises a heater for heating the object, said control means further comprising means for determining when the object attains a desired heating level, and for activating said third means at a time when both the object is at the desired heating level and said second means determines a time period has elapsed which is approximately a natural number of said first time period.

7. An electric apparatus according to claim 2, which further comprises a pre-heater for pre-heating the inside of said housing, and said controlling means further comprising means for determining when pre-heating of the inside of said housing is completed and for activating said third means so as to immediately stop the rotation of said turntable upon completion of pre-heating.

8. An electric apparatus according to claim 2, which further comprises a heater for heating the object, and said controlling means further comprising:

means for determining if a point on a front portion of said turntable prior to rotation is located in a predetermined forward range of said housing; and means for determining deactivation of said heating means and for activating said third means when both said heating means is deactivated and said point is located in the predetermined forward range of said housing during rotation of said turntable.

9. An electric apparatus according to claim 2, which further comprises a heater for heating the object, said controlling means further comprising:

fifth means for determining whether said heater has been deactivated and for communicating with said second means to determine if a time period approximately equal to a natural number multiple of the time required for one rotation of said turntable has elapsed;

sixth means for immediately activating said third means when said fifth means determines that said heater has been deactivated and a time period approximately equal to a multiple of the time required for one rotation of said turntable has elapsed;

seventh means for determining, when said sixth means fails to determine that a time period approximately equal to a multiple of the time required for one rotation of said turntable has elapsed, the time period required for said turntable to rotate until a time period approximately equal to a multiple of the time required for one rotation of said turntable has elapsed; and eighth means for determining if the time period determined by said seventh means fall within a times said first time period or (1-a) times said first time period with a falling within the range of ($0<a\leqq\frac{1}{4}$) and for activating said third means when the time period determined by said seventh means falls within a times said first time period or (1-a) times said first time period.

10. An electric apparatus according to claim 9, wherein a is equal to $\frac{1}{4}$.

11. An electric apparatus according to claim 2, wherein said electric apparatus is a microwave oven.

* * * * *